US005465661A

United States Patent [19]

White

[11] Patent Number: 5,465,661

[45] Date of Patent: Nov. 14, 1995

[54] PRINTING PRESS TEMPERATURE ADJUSTMENT SYSTEM

[75] Inventor: Jason K. White, Fontana, Calif.

[73] Assignee: R. R. Donnelley & Sons Company, Lisle, Ill.

[21] Appl. No.: 321,212

[22] Filed: Oct. 11, 1994

[51] Int. Cl.[6] ..... B41F 13/22

[52] U.S. Cl. ..... 101/219; 101/487; 101/488; 100/93 P

[58] Field of Search ..... 101/147, 148, 101/216, 217, 219, 424.1, 487, 488, DIG. 38; 492/46; 100/93 R, 93 P, 93 RP

[56] References Cited

U.S. PATENT DOCUMENTS

| | | | |
|---|---|---|---|
| 2,921,517 | 1/1960 | Disch | 101/487 |
| 2,971,460 | 2/1961 | Shindle | 101/416 |
| 4,033,376 | 7/1977 | Trelby | 137/580 |
| 4,330,238 | 5/1982 | Hoffman | 417/19 |
| 4,708,594 | 11/1987 | Shinmei et al. | 417/53 |
| 4,844,334 | 7/1989 | Hennel | 237/8 R |
| 5,044,888 | 9/1991 | Hester, II | 417/22 |
| 5,078,204 | 1/1992 | Loffredo et al. | 165/89 |
| 5,151,017 | 9/1992 | Sears et al. | 417/45 |
| 5,240,380 | 8/1993 | Mabe | 417/43 |
| 5,275,103 | 1/1994 | Hahne | 101/488 |

FOREIGN PATENT DOCUMENTS

| | | | |
|---|---|---|---|
| 0161152 | 8/1985 | Japan | 101/487 |
| 0227749 | 10/1987 | Japan | 101/487 |
| 0101938 | 4/1991 | Japan | 101/487 |

OTHER PUBLICATIONS

"Installation & Maintenance Instructions–2–Way Internal Pilot–Operated Solenoid Valves", Automatic Switch Co., 1991.

"Installation and Operation Sterlco Temperature Control Valves", Sterling, Inc., 1971.

*Primary Examiner*—Chris A. Bennett

*Attorney, Agent, or Firm*—Marshall, O'Toole, Gerstein, Murray & Borun

[57] ABSTRACT

A system for adjusting the temperature of a printing press component includes a pump for circulating a fluid to the printing press component at one of a plurality of non-zero, steady-state flow rates, a temperature sensor for detecting a temperature of the fluid, and a controller responsive to the temperature sensor for controlling the pump.

20 Claims, 3 Drawing Sheets

PRINTING PRESS TEMPERATURE ADJUSTMENT SYSTEM

TECHNICAL FIELD

The present invention relates generally to temperature control systems, and more particularly to a system for adjusting the temperature of a printing press component.

BACKGROUND ART

Printing presses for printing on a web of paper or any other suitable printing medium often use an ink which must be heated after it is applied to the web to remove moisture and solvents from the ink. Typically, the web is heated to a temperature between approximately 280° F. and approximately 375° F. (138°–191° C.). Of course, the temperature to which the web is heated depends upon the type of ink used and the composition of the web, as will be evident to those of ordinary skill in the art. Once the moisture and solvents have been removed by this heating process, the ink, and thus the web, must be cooled in order for the ink to set. In addition, the printing press itself must be cooled to protect printing press components from the high temperatures generated to heat the printed web.

Referring to FIG. 1, in a prior-art cooling system 20 for cooling a printed web 22 that has been heated as described above, four hollow, cylindrical drums or chill rolls 24 convey the web 22 away from a printing press 26 in the direction indicated by the arrow 27. Obviously, any other desired number of chill rolls 24 may be used to convey the web 22. A closed-loop circulation system 28 interconnects the chill rolls 24 to form two parallel-connected pairs, as shown. Water is circulated through the closed-loop system 28 including interior spaces 30 inside the hollow chill rolls 24 at a constant rate by a constant-speed pump 32 in order to cool the web 22 and set the ink imprinted thereon.

The temperature of the chill rolls 24 is detected by a sensor 34, and when the temperature exceeds a predetermined threshold, a control 36 opens a valve 38. When the valve 38 opens, water escapes from the otherwise closed-loop system 28 and is replaced by new, cooler water from a water supply 40 to maintain the temperature of the chill rolls 24 at a desired level. When the sensed temperature decreases below the predetermined threshold, the valve 38 is closed, and the water in the closed-loop system 28 continues to be recirculated through the system 28 by the pump 32.

In the prior-art cooling system 20, the pump 32 operates continuously at a constant speed and therefore requires a large amount of electric power to cool the chill rolls 24. Moreover, the prior-art system 20 does not always make the most efficient use of cooling water. Still further, the system 20 cools the ink rapidly and often causes the ink to undergo thermal shock which can adversely affect the appearance (e.g., reducing glossiness) of the dried ink, which is undesirable.

SUMMARY OF THE INVENTION

According to one aspect of the present invention, a system for adjusting the temperature of a printing press component includes means for circulating a fluid to the printing press component at one of a plurality of non-zero, steady-state flow rates, means for detecting a temperature of the fluid, and means responsive to the detecting means for controlling the circulating means.

In one embodiment, the printing press component includes at least one chill roll, and preferably a plurality of chill rolls, wherein the circulating means circulates fluid to the chill rolls in series. Further, the circulating means may include a pump having a variable speed for pumping the fluid to the printing press component wherein the flow rate is related to the speed of the pump.

In an alternative embodiment, the printing press component includes at least one vibrator roll, and preferably includes a plurality of vibrator rolls, wherein the circulating means circulates fluid to the vibrator rolls in parallel.

In accordance with an aspect of the present invention, the controlling means controls the speed of the pump to thereby control the flow rate of the fluid. Moreover, the controlling means may include at least one of a proportional controller, an integral controller, and a derivative controller.

Also in accordance with an aspect of the present invention, the system includes means responsive to the detecting means for replacing the fluid. In this embodiment, the detecting means may include first and second temperature sensors wherein the controlling means is responsive to the first temperature sensor and the replacing means is responsive to the second temperature sensor. The first temperature sensor is disposed at a first location, while the second temperature sensor is disposed at a second location which may be the same as, or preferably different from, the first location. Alternatively, the detecting means may include a single temperature sensor wherein the controlling means and the replacing means are responsive to the single temperature sensor. In accordance with a specific embodiment, the replacing means may include a fluid inlet and a fluid outlet and a valve for regulating replacement of the fluid. Preferably, the valve is responsive to the detecting means. Also preferably, the valve is responsive to a temperature sensor of the detecting means.

DESCRIPTION OF THE PREFERRED EMBODIMENTS

Figure 1:
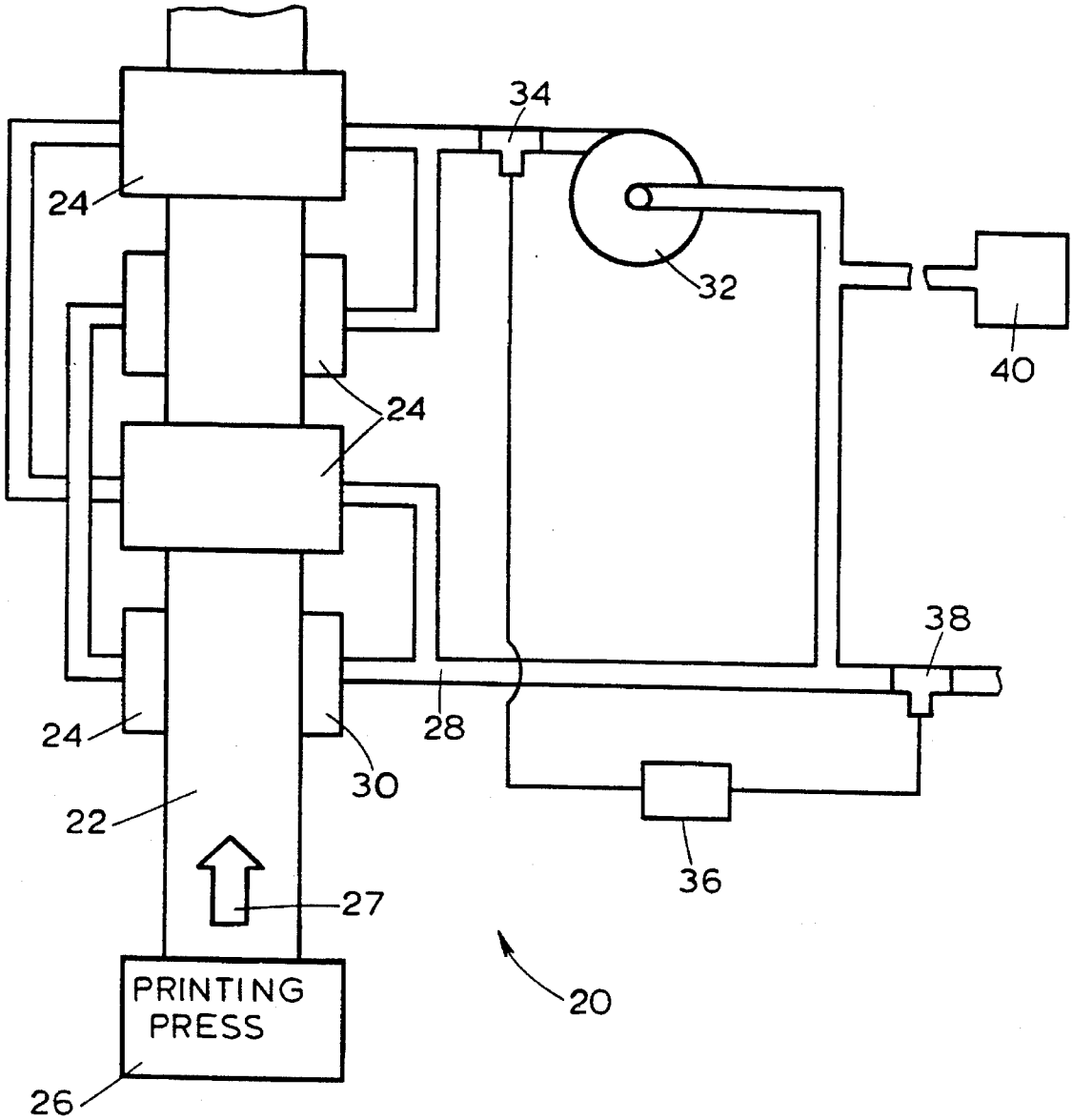
FIG. 1 PRIOR ART
FIG. 1 is a combined block and simplified schematic view of a prior-art system for cooling a printed web.
Figure 2:
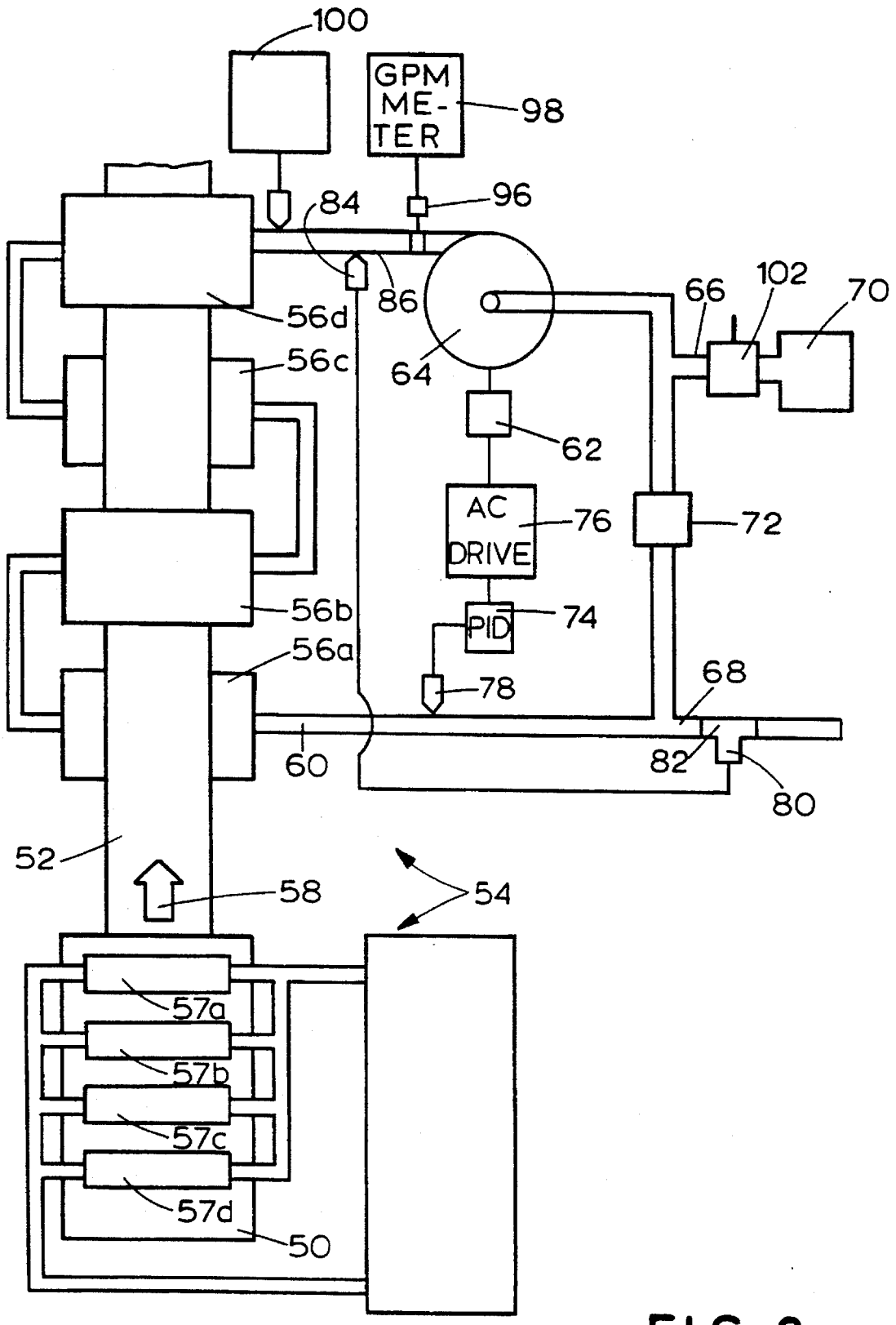
FIG. 2 is a view similar to FIG. 1 of a cooling system according to the present invention.

Referring to FIG. 2, a printing press 50 prints by depositing ink onto a web 52 made of paper or any other suitable medium. After printing, the web 52 is heated to eliminate moisture and solvents from the ink in order to ensure that the ink adheres to the web 52. The web 52 is then gradually cooled to ensure that the ink sets properly.

According to the present invention, a system 54 for cooling the web 52 includes four hollow, cylindrical drums or chill rolls **56*a*–56*d* for conveying the heated web 52 as it emerges from the printing press 50. Of course, any other desired number of chill rolls 56 could be used instead. Moreover, while the embodiment of the system 54 described herein is used for cooling the chill rolls 56*a*–56*d*, and thus the web 52 as it emerges from the printing press 50, the system 54 could alternatively or in addition be used to cool vibrator rolls 57*a*–57*d* disposed within the printing press 50** for applying ink to the web 52 therein. In this case, the cooling system 54 carries away heat generated by friction. Because the cooling system 54 is essentially the same in the chill roll and vibrator roll embodiments, only the chill roll embodiment is described in detail herein. Details particular to the vibrator roll embodiment are provided only where necessary to an understanding of that aspect of the present invention.

Downstream of the printing press 50, the web 52 is threaded alternately around the chill rolls 56*a*–56*d*, and the latter rotate and convey the web 52 away from the printing press 50 in the direction indicated by the arrow 58. In other words, as shown in FIG. 2, the web 52 is wrapped over the chill roll 56*a*, under the chill roll 56*b*, over the chill roll 56*c*, and under the chill roll 56*d*. Further, although the chill rolls 56*a*–56*d* may be disposed in a single plane or multiple planes as shown in FIG. 2, it will be apparent to those skilled in the art that the chill rolls 56*a*–56*d* can be disposed in any other convenient configuration, if desired. In fact, the chill rolls 56*a*–56*d* may be advantageously oriented in two pairs such that a first pair 56*a* and 56*c* is disposed above a second pair 56*b* and 56*d* in order to reduce the floor space occupied by the chill rolls 56*a*–56*d*.

A closed-loop circulation system 60 serially interconnects and provides fluid communication among the chill rolls 56*a*–56*d*. A variable-speed motor drive 62 drives a pump 64 which, in turn, is coupled in the circulation system 60 for circulating a cooling fluid, such as water, to the chill rolls 56*a*–56*d* at one of a plurality of non-zero, steady-state flow rates. In other words, when the pump 64 is operating, cooling fluid is circulated at a variable and selectable steady-state flow rate in either direction (i.e., counterclockwise or clockwise as shown in FIG. 2) through the circulation system 60.

In ordinary operation, the fluid flows counterclockwise through the circulation system 60 (i.e., through the chill rolls 56*d*–56*a* in order) to protect the ink from thermal shock which can adversely affect the appearance of the dried ink. Because the cool fluid circulates in serial order through the chill rolls 56*d*–56*a*, the fluid temperature is lowest at the chill roll 56*d*, which is disposed farthest away from the printing press 50. The fluid temperature is relatively greater at each successive chill roll 56 in the circulation system 60. Consequently, the heated, printed web 52 first contacts the chill roll 56*a*, which is at the highest temperature among the chill rolls 56*a*–56*d*. The web 52 is then sequentially conveyed along the progressively cooler chill rolls 56*b*, 56*c*, and 56*d* and is gradually cooled rather than being thermally shocked by a sudden and substantial temperature drop.

In some applications, such as in the vibrator roll embodiment as described above (where thermal shock is not a problem), it may be desirable to cool all of the rolls 57*a*–57*d* to the same temperature. To do so, the rolls may be interconnected in parallel, or in any other suitable configuration, rather than in the serial configuration of the chill rolls 56*a*–56*d* shown in FIG. 2.

The system 60 includes a fluid inlet 66 and a fluid outlet 68. The fluid inlet 66 is connected to a fluid supply 70 from which fresh cooling fluid may be introduced into the system 60. The fluid outlet 68 permits fluid to escape from the system 60 to be cooled and recirculated to the fluid supply 70 for reintroduction into the system 60. More particularly, because the system 60 is a closed-loop system with a fixed total volume, whenever fluid is released through the outlet 68, it is simultaneously replaced by new, cool fluid which automatically flows into the inlet 66 from the fluid supply 70.

A check valve 72 is disposed in the circulation system 60 between the fluid inlet 66 and the fluid outlet 68 to prevent the cool fluid introduced at the fluid inlet 66 from flowing directly out of the system 60 through the fluid outlet 68. The check valve 72 thereby ensures that the introduced cool fluid is circulated through the pump 64 and the chill rolls 56*a*–56*d* to provide the desired cooling effect.

The rate of cooling is related to the rate of circulation of fluid through the system 60 by the pump 64 as well as to the rate of introduction of cool replacement fluid into the system 60. As the rate of introduction of cooling fluid increases, the rate of cooling of the chill rolls 56*a*–56*d* also increases. The variable-speed motor 62, which drives the variable-speed pump 64, is controlled by a proportional-integral-derivative (or PID) controller 74 and an AC drive unit 76. The PID controller 74 is responsive to the temperature of the fluid in the system downstream of the chill roll 56a as detected by a temperature sensor 78. The AC drive unit 76 provides proper electrical drive current and voltage to the motor 62 based upon the output of the controller 74.

Instead of the PID controller 74, any suitable controller may be used to control the motor 62 in order to regulate the flow rate of fluid circulating through the system 60. For example, a proportional controller, an integral controller, a derivative controller, or any combination of these may be used to control the motor 62. Moreover, the temperature sensor 78 may be placed in any other convenient location in the circulation system 60, but the best results are obtained when the sensor 78 is disposed between the chill roll 56*a* and the fluid outlet 68 as shown in FIG. 2.

The rate of discharge of fluid from the system 60 through the fluid outlet 68, and thus the rate of introduction of cooling fluid from the fluid supply 70 into the system 60 through the inlet 66 to replace the discharged fluid, is regulated by a modulating control valve 80, which may comprise a Sterlco Automatic Control valve manufactured by Sterling, Inc., of Milwaukee, Wis. When the valve 80 is closed, no new fluid flows from the fluid supply 70 into the system 60; rather, the fluid then in the circulation system 60 is recirculated by the pump 64.

The valve 80 includes a valve unit 82 having an actuator (not shown) therein, which is opened or closed to control the admittance of fresh fluid from the supply 70 in response to a temperature signal developed by a remote thermocouple or temperature sensor 84. The thermocouple 84 is thermally coupled to the circulation system 60 at a location 86 as shown in FIG. 2. Of course, the thermocouple 84 may be placed in any other convenient location in the circulation system 60, but the best results are obtained when the thermocouple 84 is disposed between the pump 64 and the chill roll 56d as shown in FIG. 2. The valve 80 opens to release fluid from the system 60 allowing new cool fluid to enter when the fluid in the system 60 exceeds a predetermined threshold. When enough cool fluid has entered the system 60 to reduce the temperature of the fluid therein below that threshold, the valve 80 closes and normal recirculation of the fluid resumes as described below.

Figure 3:
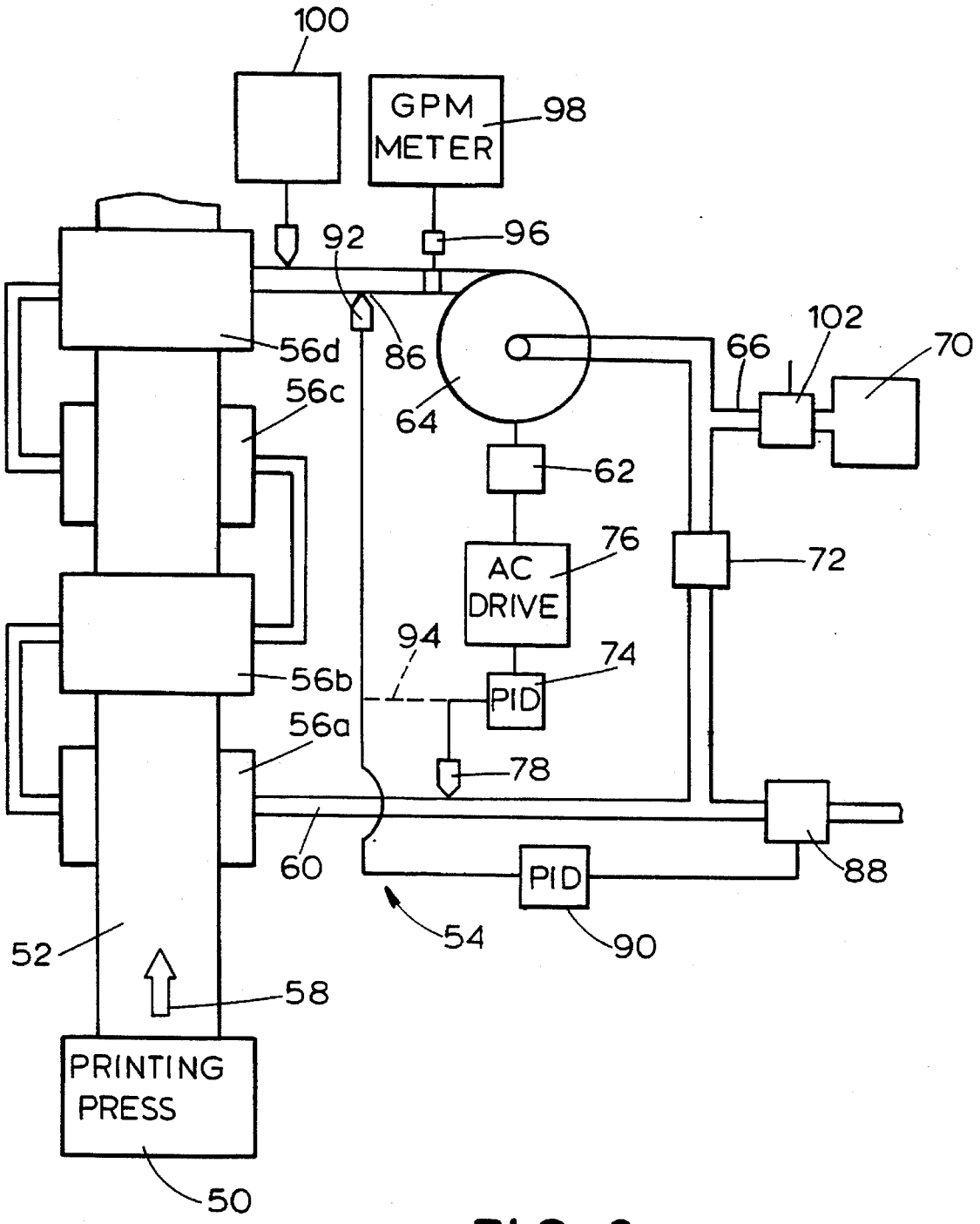
FIG. 3 is a view similar to FIG. 2 of an alternative embodiment of the cooling system according to the present invention wherein elements common to FIGS. 2 and 3 are assigned like reference numerals.

Referring now to FIG. 3, the valve 80 described above may be replaced by an electrically actuated valve 88, if desired. Such an electrically actuated valve 88 requires an independent controller 90 (e.g., a PID controller similar to the controller 74) and a temperature sensor 92, which may be disposed at the location of the thermocouple 84 or any other desired location in the circulation system 60. Identical to the valve 80, the electrically actuated valve 88 is operated to permit fluid to escape from the system 60, permitting new, cool fluid to enter, when the temperature of the fluid in the system 60, detected by the temperature sensor 92, exceeds a predetermined threshold. The valve 88, like the valve 80, is closed when the fluid temperature falls below the threshold. In this embodiment, as indicated by the dashed line 94 in FIG. 3, the controller 74 and the controller 90 could instead be responsive to a single, conveniently located temperature sensor, e.g., either one of the temperature sensors 78 or 92.

In either embodiment of FIGS. 2 and 3, a flow meter 96 may be coupled to the circulation system 60 in a convenient location, and a display 98 may be coupled to the flow meter 96 to display the number of gallons per minute (GPM) flowing through the circulation system 60. Further, additional temperature sensors may be thermally coupled to the circulation system 60 and the chill rolls 56*a*–56*d* and to a temperature meter 100 to provide additional temperature data about the cooling system 54. Such devices may be provided to facilitate troubleshooting.

Optionally, a valve 102 may be coupled to the circulation system 60 at the fluid inlet 66 to prevent fluid from the fluid supply 70 from entering the system 60 while the printing press 50 is turned off. While the printing press 50 is running and the cooling system 54 is operative, the valve 102 is opened so that fluid can enter the circulation system 60 whenever necessary as described above.

The foregoing description is for the purpose of teaching those skilled in the art the best mode of carrying out the invention and is to be construed as illustrative only. Numerous modifications and alternative embodiments of the invention will be apparent to those skilled in the art in view of this description. The details of the disclosed structure may be varied substantially without departing from the spirit of the invention, and the exclusive use of all modifications within the scope of the appended claims is reserved.

What is claimed is:

1. A printing press temperature adjustment system, comprising:

circulating means, including a pump operable at a variable speed, for circulating a fluid to a printing press component at one of a plurality of non-zero, steady-state flow rates, wherein the flow rate is related to the speed of the pump;

detecting means for detecting a temperature of the fluid; and controlling means responsive to the detecting means for controlling the circulating means.

2. The system of claim 1, wherein the circulating means circulates fluid to a chill roll.

3. The system of claim 1, wherein the circulating means circulates fluid to a plurality of chill rolls in series.

4. The system of claim 1, wherein the circulating means circulates fluid to a vibrator roll.

5. The system of claim 1, wherein the circulating means circulates fluid to a plurality of vibrator rolls in parallel.

6. The system of claim 1, wherein the controlling means controls the speed of the pump to thereby control the flow rate of the fluid.

7. The system of claim 1, wherein the controlling means produces an output for controlling the pump wherein the output is proportional to at least one of the temperature, an integral of the temperature, and a derivative of the temperature.

8. The system of claim 1, further including replacing means responsive to the detecting means for replacing the fluid.

9. The system of claim 8, wherein the detecting means includes first and second temperature sensors and wherein the controlling means is responsive to the first temperature sensor and the replacing means is responsive to the second temperature sensor.

10. The system of claim 9, wherein the first temperature sensor is disposed at a first location and the second temperature sensor is disposed at a second location.

11. The system of claim 10, wherein the first location differs from the second location.

12. The system of claim 8, wherein the detecting means includes a single temperature sensor and wherein the controlling means and the replacing means are responsive to the single temperature sensor.

13. The system of claim 8, wherein the replacing means includes a fluid inlet and a fluid outlet and a valve for regulating replacement of the fluid.

14. The system of claim 13, wherein the valve is responsive to the detecting means.

15. The system of claim 13, wherein the detecting means includes a temperature sensor and wherein the valve is responsive to the temperature sensor.

16. A printing press temperature adjustment system, comprising:

a pump operable at a variable speed for circulating a fluid to a printing press roll at a plurality of non-zero, steady-state flow rates;

a sensor for detecting a temperature of the fluid;

a controller responsive to the sensor for controlling the speed of the pump; and a valve responsive to the controller for regulating replacement of the fluid.

17. The system of claim 16, wherein the sensor includes a first sensor for detecting a first temperature of the fluid and a second sensor for detecting a second temperature of the fluid and wherein the controller is responsive to the first sensor and the valve is responsive to the second sensor.

18. The system of claim 17, wherein the first and second temperature sensors are disposed in different locations.

19. The system of claim 16, wherein the controller produces an output for controlling the pump wherein the output is proportional to at least one of the temperature, an integral of the temperature, and a derivative of the temperature.

20. In combination with the system of claim 16, a cooling system including at least two printing press rolls, wherein the pump circulates fluid to the printing press rolls.

* * * * *